US005179982A

United States Patent [19]

Bérubé et al.

[11] Patent Number: 5,179,982

[45] Date of Patent: Jan. 19, 1993

[54] APPARATUS FOR DISCHARGING A FLUID AND, MORE PARTICULARLY, FOR SPRAYING A LIQUID

[75] Inventors: Martin Bérubé, 5440 - 74 boul. Talbot, Laterrière, Québec, Canada, G0V 1K0; Julien Bilodeau, 940 Thérèse-Casgrain, Apt. 129, Chicoutimi, Québec, Canada, G7H 6K8; Marlène Paul, 1273 boul. Renaud, Apt. 9, Chicoutimi, Qébec, Canada, G7H 3N7; Ronald Gaucher, 4295 St-Martin, Chicoutimi, Québec, Canada, G7H 5A7; Germain Côté; Guy Boudreault, both of Chicoutimi, Canada

[73] Assignees: Martin Bérubé, Laterrière; Julien Bilodeau, Chicoutimi; Marlène Paul, Chicoutimi; Ronald Gaucher, Chicoutimi, all of Canada

[21] Appl. No.: 527,448

[22] Filed: May 23, 1990

[51] Int. Cl.[5] ..... B65B 3/00

[52] U.S. Cl. ..... 141/20; 141/113; 141/114; 222/105; 222/386.5; 222/95

[58] Field of Search ..... 141/98, 3, 20, 113, 141/114; 222/399, 95, 105, 183, 386.5, 394, 386, 402.1, 387

[56] References Cited

U.S. PATENT DOCUMENTS

| | | | |
|---|---|---|---|
| 2,471,852 | 5/1949 | Bau | 222/95 |
| 2,823,953 | 7/1958 | McGeorge . | |
| 3,055,553 | 9/1962 | Mapes et al. | 222/95 |
| 3,592,244 | 7/1971 | Chamberlin | 141/20 X |
| 3,601,164 | 8/1971 | Bruce | 141/20 |
| 4,162,030 | 7/1979 | Capra et al. | 222/721 X |
| 4,456,155 | 6/1984 | Miyata et al. | 222/796 |
| 4,577,803 | 3/1986 | Owen | 141/20 X |
| 4,595,126 | 6/1986 | Holmes | 222/105 |

FOREIGN PATENT DOCUMENTS

| | | | |
|---|---|---|---|
| 1022104 | 3/1966 | United Kingdom | 222/95 |

*Primary Examiner*—Ernest G. Cusick
*Attorney, Agent, or Firm*—Samuel Meerkreebs

[57] ABSTRACT

A liquid dispensing apparatus comprises a container having a peripheral sidewall, a bottom wall mounted at a lower end of the sidewall and a closure removably mounted to an upper end of the sidewall. A flexible tight plastic bag is mounted at an upper end thereof between the closure and the sidewall in order to hang in the container. The bag thus defines in the container a first and a second chamber which respectively contain the liquid to be dispensed and compressed air. A nozzle extends through the closure into the first chamber. A pressure regulating valve is mounted in the second chamber and defines therein an upper and a lower sub-chamber, with the bag being submitted to forces exerted by the compressed air contained in the upper sub-chamber. The pressure regulating valve ensures a constant pressure in the upper sub-chamber and thus on the bag, whereas the lower sub-chamber acts as a reservoir for the upper sub-chamber. An admission valve extends through the bottom wall into the lower sub-chamber for filling the container with compressed air. Safety valves are also provided in the upper and lower sub-chambers. Therefore, upon actuation of the nozzle, liquid contained in the first chamber is atomized and discharged from the container through the nozzle as the liquid is submitted to the pressure of the compressed air contained in the upper sub-chamber.

19 Claims, 2 Drawing Sheets

APPARATUS FOR DISCHARGING A FLUID AND, MORE PARTICULARLY, FOR SPRAYING A LIQUID

BACKGROUND OF THE INVENTION

1. Field of the Invention

The present invention relates to fluid dispensing apparatuses and, more particularly, to a liquid spraying apparatus which is environmentally safe.

2. Description of the Prior Art

Aerosol cans are well known as conventional liquid spraying apparatuses of everyday use. In conventional aerosol cans, the liquid to be sprayed is directly mixed in a single chamber of the container with a propellant, which is generally an inert gas such as chlorofluorocarbons (i.e. CFCs), whereby the liquid does not react with the propellant. CFCs have been widely used as refrigerator coolants, spray can propellants and foaming agent. CFCs being stable gases have a chemical inertness which is the source of both their usefulness and their danger. They do not react with, for instance, the deodorant they are meant to spray, but they can also spend years rising through the atmosphere without breaking down. However, when the CFCs reach the stratosphere, their chlorine atoms react with ozone to create conventional oxygen and chlorine monoxide. The chlorine monoxide then reacts with maverick oxygen atoms to form conventional oxygen and another chlorine atom, and so on. A single chlorine atom can destroy thousands of ozone molecules.

When the spray tip of such an aerosol can is actuated, the CFCs cause the liquid to atomize with both being discharged from the spray tip. Therefore, the harmful CFCs are emitted in the atmosphere where, as it is now widely known, they damage and even destroy the ozone layer of the atmosphere thereby contributing to the greenhouse effect. Furthermore, containers operating with CFCs cannot be refilled nor recycled.

Following pressures from the population, aerosol cans using CFCs have been eliminated from the market in most part.

To overcome these disadvantages, the vaporization or atomization of the liquid contained in some prior art containers resulted from an inert gas dissolved in this liquid. Such containers responded adequately to the problems generated by the use of CFCs although they suffer from further problems such as, for instance, a non constant stream due to the gas pressure progressively decreasing in the container.

To prevent the propellant from discharging with the liquid, containers were developed having a pair of separate chambers respectively containing the fluid to be dispensed and the propellant, as disclosed in U.S. Pat. No. 2,823,953 issued in 1958 to McGeorge. Indeed, McGeorge discloses a container having a flexible bag hanging therein from an exterior wall thereof. The flexible bag contains the liquid to be dispensed from the container. A compressed gas exerts within the container a pressure on the walls of the flexible bag. The container includes a removable cover that allows the flexible bag to be filled up once emptied. The bag and the cover are adapted to form a seal between the content of the flexible bag and the exterior of the container. An admission valve is provided to allow the container to be filled with the compressed gas.

Again, the main disadvantage of the above container lies in that the pressure exerted by the gas on the flexible bag progressively decreases as the bag is emptied. Therefore, the atomization of the liquid contained in the bag is not constant during each cycle of the container.

Moreover, the container being refillable, it is preferable that the bag, which may be discarded in the event, for instance, where a new fluid is intended to be used, be designed to be easily mounted to the container.

SUMMARY OF THE INVENTION

It is therefore an aim of the present invention to provide a liquid spraying apparatus which does not release pollutants in the atmosphere.

It is also an aim of the present invention to provide a liquid spraying apparatus in which the liquid to be discharged is isolated from the propellant.

It is a further aim of the present invention to provide a liquid spraying apparatus which is refillable.

It is still a further aim of the present invention to provide a liquid spraying apparatus in which the liquid can be discharged therefrom whatever the orientation of the liquid spraying apparatus.

It is still a further aim of the present invention to provide a liquid spraying apparatus in which the liquid is dispensed therefrom at a constant rate.

It is still a further aim of the present invention to provide a liquid spraying apparatus which is easily and safely refilled by a user.

A construction in accordance with the present invention comprises a fluid dispensing apparatus which includes a container means and a displaceable partition means in the container means for defining therein first and second separate variable volume chamber means which contain respectively a fluid and a propellant means. The second chamber means comprises first and second sub-chambers and a pressure regulating means provided therebetween. The second chamber means is adapted in order that the propellant means in the first sub-chamber exerts a substantially constant pressure on the partition means and therefor on the fluid. An operable fluid dispensing means extends through the container means into the first chamber means. Therefore, actuation of the fluid dispensing means causes at least part of the fluid to discharge from the container means.

In a more specific construction in accordance with the present invention, the container means comprises an upstanding tubular sidewall, and a closure and a bottom wall mounted respectively at upper and lower ends of the sidewall. The fluid dispensing means extends through the closure. The displaceable partition means is a flexible tight bag means mounted at an upper open end thereof to the container means. The bag means contains the fluid with the propellant means in the first sub-chamber exerting pressure on the bag means. A sealing means is provided for preventing the propellant means from entering the first chamber means.

In a still more specific construction in accordance with the present invention, the propellant means is a compressed gas, such as air, and the bag means is made of a plastics material, such as latex.

In a still more specific construction in accordance with the present invention, the sidewall comprises an annular member extending radially inwardly therefrom intermediate the upper and lower ends thereof thereby defining a throat in the second chamber means lower than the bag means. The pressure regulating means comprises a pressure regulating valve mounted to the throat. Therefore, the first and second sub-chambers are respectively upper and lower sub-chambers. A bottom of the bag means hanging in the upper sub-chamber is at least partly supported by the annular member at least when the bag means is filled with the fluid. The lower sub-chamber acts as a reservoir for the upper sub-chamber for ensuring by way of the pressure regulating valve compressed air of substantially constant pressure in the upper sub-chamber. Therefore, the fluid is discharged with a substantially constant flow from the first chamber means.

In a still more specific construction in accordance with the present invention, the closure is removably mounted to the sidewall with an admission means extending through the container means into the lower sub-chamber for the filling thereof with compressed air. At least a first safety valve means is provided in the lower sub-chamber. The fluid dispensing apparatus is thus refillable.

In a still more specific construction in accordance with the present invention, the upper open end of the bag means is removably mounted between the upper end of the sidewall and the closure by an O-ring means urging the upper open end of the bag means in a peripheral groove defined in an outer surface of the upper end of the sidewall. The O-ring is urged in the groove by the closure thereby preventing the fluid and the compressed air from leaking from the container means.

In a still more specific construction in accordance with the present invention, a tabletop compressor unit is provided in combination with the fluid dispensing apparatus. The tabletop compressor unit comprises a housing enclosing a compressor and including a means adapted for holding the container means thereon and for supplying compressed air to the container means through the admission means upon actuation of the compressor. Therefore, the container can be refilled with compressed air.

In a still more specific construction in accordance with the present invention, the O-ring means is integral to the upper open end of the bag means. The groove is defined with a substantially semi-circular cross-section with the upper end of the sidewall having a frusto-conical shape for facilitating the positioning of the O-ring means in the groove.

A further construction in accordance with the present invention comprises a fluid dispensing apparatus including a container means which comprises an upstanding tubular sidewall and a bottom wall mounted at a lower end of the sidewall. The container means also comprises a removable closure mounted to an upper end of the sidewall. A flexible tight bag means having an upper peripheral open end hangs in the container means with the upper open end thereof being peripherally mounted between the closure and the upper end of the sidewall. The bag means defines first and second chambers in the container means containing respectively a fluid and compressed air. A fluid dispensing means extends through the closure into the first chamber. A partition wall means extending inwards from the sidewall in the container means lower than the bag means and a pressure regulating means mounted to the partition wall means define in the second chamber an upper and a lower sub-chamber. The pressure regulating means is adapted to provide a substantially constant air pressure in the upper sub-chamber and thus on the bag means. An admission means extends through the bottom wall into the lower sub-chamber for filling the container means with compressed air.

Also in accordance with the present invention there is provided a method for filling a substantially empty refillable fluid dispensing apparatus. The apparatus comprises a container means having a peripheral sidewall, a bottom wall at a lower end of the sidewall and a closure removably mounted to an upper end of the sidewall. A flexible tight bag means is mounted at an upper peripheral open end thereof between the closure and the sidewall and hangs in the container means thereby defining first and second chambers therein. The first and second chambers respectively contain a fluid and compressed air. A fluid dispensing means extends through the closure into the first chamber. A partition wall mounted in the container means lower than the bag means and a pressure regulating means mounted to the partition wall define in the second chamber upper and lower sub-chambers. The pressure regulating means provides a substantially constant air pressure in the upper sub-chamber and thus on the bag means. An admission means extends through the bottom wall into the lower sub-chamber. The method comprises the steps of:

a) depressurizing the container means by way of the admission means;

b) removing the closure from the sidewall;

c) filling the first chamber with a desired fluid;

d) securely and sealingly mounting the closure to the sidewall; and e) filling the second chamber with compressed air by way of the admission means.

BRIEF DESCRIPTION OF THE DRAWINGS

Having thus generally described the nature of the invention, reference will now be made to the accompanying drawings, showing by way of illustration a preferred embodiment thereof, and wherein.

DESCRIPTION OF THE PREFERRED EMBODIMENTS

Figure 1:
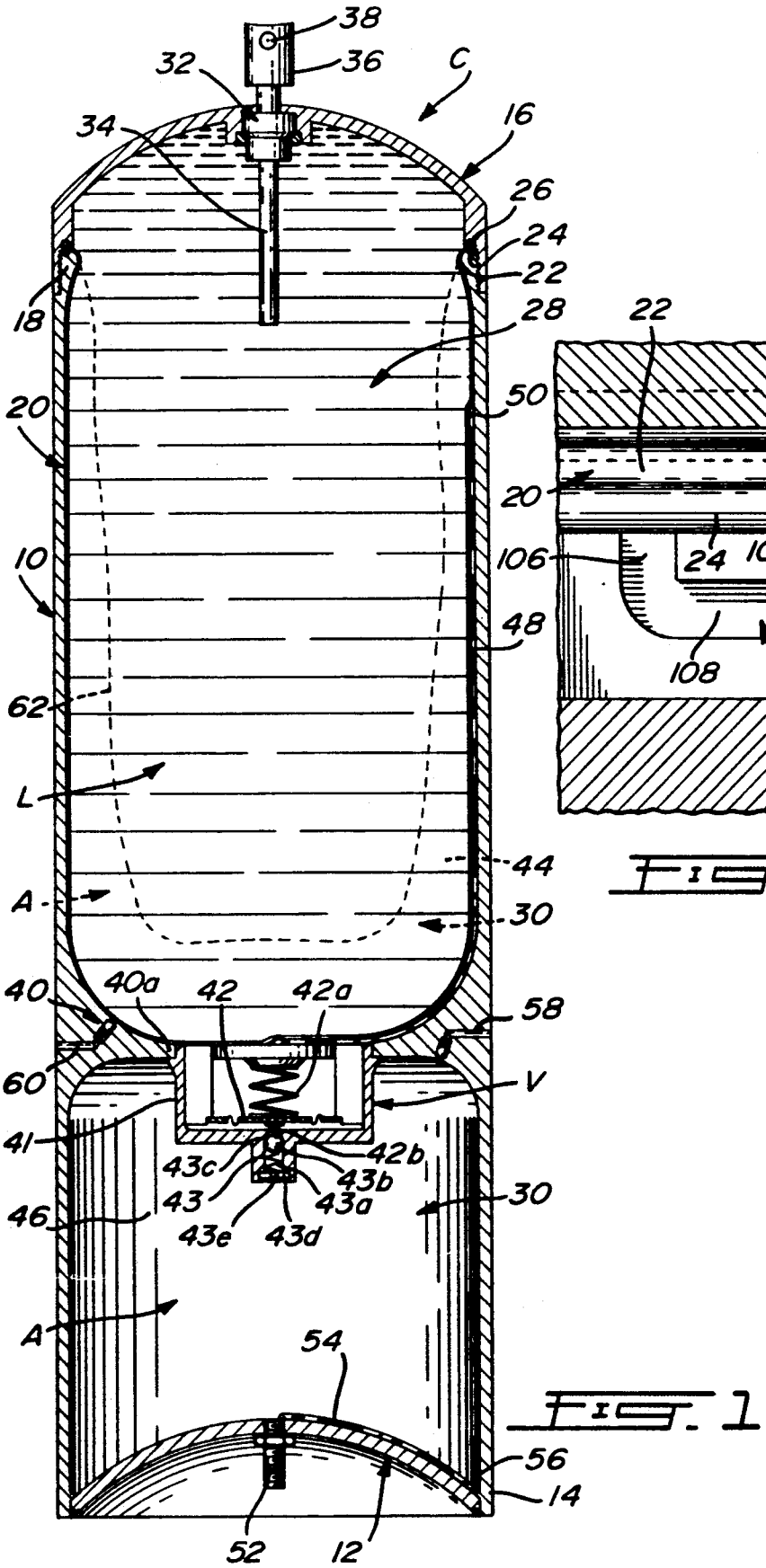
FIG. 1 is a cross-sectional elevation of a liquid spraying apparatus in accordance with the present invention.

A refillable liquid spraying apparatus in accordance with the present invention comprises a sealed container C which includes an upstanding tubular cylindrical sidewall 10, a concave bottom wall 12 fixedly mounted at a lower end 14 of the sidewall 10, and a closure 16 threadably secured to an upper end 18 of the sidewall 10.

A flexible tight bag 20, preferably made of a plastics material such as latex, is fixedly mounted at an upper peripheral open end 22 thereof between the closure 16 and the sidewall 10. The upper end 22 of the bag 20 is provided with an integral O-ring 24 which at least partly lodges in an annular groove of semicircular cross-section defined on top of the upper end 18 of the sidewall 10. An annular seal 26 is positioned in an annular groove defined in the closure 16, whereby the seal 26 overlies the O-ring 24 thereby providing a seal between the closure 16 and the sidewall 10 as well as securing the bag 20 which hangs inside the container C.

Therefore, the bag 20 defines in the container C first and second separate chambers 28 and 30, respectively. The first chamber 28 is filled with a liquid L to be dispensed from the container C, whereas the second chamber 30 contains a propellant such as compressed air A.

A nozzle 32 which extends through the closure 16 includes a conventional operable valve (not shown), a tube 34 which extends downwards into the first chamber 28 in order to have its lower end immerged in the liquid L, a push button 36 and a discharge opening 38 defined in the push button 36. Therefore, upon a downwards depression of the push button 36, the valve of the nozzle 32 opens thereby allowing the liquid L to pass through the tube 34 and to be discharged from the nozzle 32 through the discharge opening 38 as the liquid L is pressurized by the compressed air A.

An integral annular member 40 extends radially inwards with a taper from the sidewall 10 lower than the bottom of the bag 20 to define a throat 40*a* in the second chamber 30. A dual function pressure regulating valve and bleeding device V is mounted in the throat thereby defining in the second chamber 30 upper and lower sub-chambers 44 and 46, respectively. The lower sub-chamber 46 acts as a reservoir for the compressed air A, with the pressure regulating valve V ensuring a constant pressure in the upper sub-chamber 44 and thus on the bag 20. Such a constant air pressure on the bag 20 results in a constant atomization of the liquid L and thus in a constant flow of liquid spray discharged through the nozzle 32. The pressure regulating valve also allows to bleed the upper sub-chamber 44 to remove the pressure therefrom when the pressure in the lower sub-chamber 46 is at or near atmospheric pressure.

The annular member 40 also serves to at least partly support the bag 20 until the bag 20 is emptied to some extent.

The pressure regulating valve V, which is of a known construction comprises a housing 41 and a spring biased release plate 42 which includes a valve opening member 42*b* which bears against a ball 43*b* of a spring biased ball valve 43. A spring 43*a* of the ball valve 43 which is held in the housing 41 by a support plate 43*d* anchored therein urges the ball 43*b* against a valve seat 43*c* defined by the housing 41, with the release plate 42 being urged against the ball 43*b* by a compressed spring 42*a*. The support plate 43*d* is provided with an aperture 43*e*.

Air from the upper sub-chamber 44 which is allowed into the housing 41 of the pressure regulating valve V by a hole (not shown) defined therein exerts a pressure on the underside of the release plate 42. When the air in the upper sub-chamber 44 has a pressure equal to the predetermined setting of the pressure regulating valve V, forces exerted thereby on the release plate 42 are in equilibrium with the forces applied on the release plate 42 by the compressed spring 42*a*. Therefore, the ball 43*b* remains seated against the valve seat 43*c*, as seen in FIG. 1, to prevent air transfer from the lower sub-chamber 46 to the upper sub-chamber 44.

Upon a drop in the air pressure in the upper sub-chamber 44 following the discharge of some of the liquid L from the container C, the volume of the first chamber 28 defined by the bag 20 decreases, whereby the volume of the upper sub-chamber 44 increases thereby lowering the air pressure therein. When the air pressure in the upper sub-chamber 44 is lower than the predetermined valve setting, the forces exerted by the spring 42*a* on the release plate 42 are greater than the forces exerted thereon by the compressed air contained in the upper sub-chamber 44. Therefore, the spring 42*a* forces the release plate 42 downwards, whereby the valve opening member 42*b* displaces the ball 43*b* against the spring 43*a*. The ball 43*b* being displaced away from the valve seat 43*c* allows high pressure air from the lower sub-chamber 46 to enter the upper sub-chamber 44 through the aperture 43*e* defined in the support plate 43*d*. It is easily seen that the configuration of the valve opening member 42*b* prevents the release plate 42 from closing the opening defined above the ball 43*b* and the valve seat 43*c*.

As the difference between the forces exerted on the release plate 42 by the spring 42*a* and by the air from the upper sub-chamber 44 contained in the valve housing 41 gradually diminishes, the release plate 42 displaces upwards until an equilibrium of forces is reached at which point the ball 43*b* bears once again against the valve seat 43*c* and prevents further air transfer from the lower sub-chamber 46 to the upper sub-chamber 44.

Therefore, the pressure regulating valve V opens when the air pressure in the upper sub-chamber 44 is lower than a predetermined value to allow compressed air contained in the higher pressure lower sub-chamber 46 to flow into the upper sub-chamber 44. The pressure regulating valve V closes when the desired air pressure is obtained in the upper sub-chamber 44 whereby a constant pressure can act on the bag 20 throughout the utilization of the container C.

Also, the force of spring 42*a* is opposed by the force of spring 43*a* and slightly by the pressure in the lower sub-chamber 46 as it also acts on the ball 43*b*. In the present embodiment wherein, as described in detail hereinafter, it is intended to make the container C refillable, it is necessary to remove the air pressure from the lower sub-chamber 46 using an admission valve 52. As, for safety reasons, it is also required that the air pressure be also removed from the upper sub-chamber 44, the regulator V is designed, as seen in FIG. 1, to bleed the air from the upper to the lower sub-chamber 46 and 44, respectively, once pressure in the latter is low. This results from the fact that, when pressure is very low in the lower sub-chamber 46, the equilibrium of forces on the ball 43*b* is broken as there is substantially no air pressure assisting the spring 43*a* against the spring 42*a*, whereby the release plate 42 is caused to lower and dislodge the ball 43*b* from the valve seat 43*a*. Accordingly, air flows through the regulating valve V or bleeder from the upper to the lower sub-chamber 44 and 46, and then out of the container C through the admission valve 52.

In this preferred embodiment, a tube 48 is provided which extends from an outlet of the pressure regulating valve V into the upper sub-chamber 44, and further extends upwards between the sidewall 10 and the bag 20 so that an open free end 50 of the tube 48 is located near the upper end 18 of the sidewall 10. Accordingly, following a possible rupture of the bag 20 and subsequent leaking of the liquid L contained therein in the upper sub-chamber 44, the tube 48 will prevent the pressure regulating valve V from being clogged and possibly damaged by the leaked liquid.

The admission valve 52 extends through the bottom wall 12 into the lower sub-chamber 46 for filling the second chamber 30 of the container C with compressed air A, when required, such as when refilling the container C. The admission valve 52 can be of the type used for automobile tubeless tires and for bicycle air chambers. When it is necessary to depressurize the container C, compressed air is evacuated therefrom using the admission valve 52. A tube 54 extends from the admission valve 52 into a lower peripheral section 56 of the lower sub-chamber 46 in order that when compressed air is discharged from the container C through the admission valve 52, a formed condensate deposited in the peripheral section 56 of the lower sub-chamber 46 is simultaneously evacuated therefrom. As explained hereinabove, the bleeder feature of the regulating valve V allows for the evacuation of pressurized air also from the upper sub-chamber 44, thereby allowing the closure 16 to be removed from the container C.

A first safety valve 58 is provided between the lower sub-chamber 46 and the exterior of the container C in order that a predetermined air pressure is not exceeded therein. Similarly, a second safety valve 60 is provided between the upper sub-chamber 44 and the exterior of the container C in order that a predetermined air pressure is not exceeded therein in the event, for instance, of a malfunction of the pressure regulating valve V.

The container C described hereinabove basically functions as follows. Compressed air A fills both the upper and lower sub-chambers 44 and 46. The pressure regulating valve V ensures a constant air pressure in the upper sub-chamber 44 with the lower chamber 46 acting as a reservoir for the upper sub-chamber 44. The compressed air A contained in the upper chamber 44 exerts a pressure on the bag 20 whereby the liquid L contained in the bag 20 is also pressurized. Therefore, upon depressing the push button 36 of the nozzle 32, the valve of the nozzle 32 opens thereby allowing pressurized liquid L to flow through the tube 34 of the nozzle 32 and to discharge from the container C through the discharge opening 38. As the bag 20 contains less liquid L, it folds up under the pressure of the compressed air A contained in the upper sub-chamber 44. Upon progressive emptying thereof, the bag 20 is forced gradually inwards and upwards as indicated by the bag shown in dotted lines 62 on FIG. 1. The volume of the upper sub-chamber 44 therefore gradually increases. Again, the pressure regulating valve V ensures that the air pressure in the upper sub-chamber 44 remains constant as further described hereinbelow.

The reduction of the volume of the bag 20 and the air pressure exerted thereon result in a substantially constant level of the liquid L in the bag 20 with respect to the sidewall 10 and the closure 16. The compressed air A contained in the upper sub-chamber 44 will always force the liquid L in the bag 20 in its uppermost position. This explains why it is not necessary for the tube 34 of the nozzle 32 to extend downwards right near the bottom of the bag 20. In fact, in some container constructions, there is no such tube 34.

As the volume of the bag 20 decreases, the volume of the upper sub-chamber 44 increases thereby resulting in a lowering of the pressure of the compressed air A contained therein. The pressure regulating valve V will thus open to allow compressed air A of higher pressure contained in the lower sub-chamber 46 to flow through the pressure regulating valve V into the upper sub-chamber 44 until the desired air pressure is obtained therein. The pressure regulating valve V will then close.

Experiments have shown that the bag 20 will become substantially completely empty of liquid L. Once the container C is empty of liquid L, the admission valve 52 is opened to depressurize the second chamber 30. Then, the closure 16 can be removed from the sidewall 10. The bag 20 can then be filled with a desired liquid L. The closure 16 is repositioned onto the sidewall 10 while ensuring that the upper end 22 of the bag 20 is properly secured between the sidewall 10 and the closure 16. Compressed air can then be supplied into the second chamber 30 by way of the admission valve 52 until the desired air pressure is obtained therein. The container C is then ready to be used for dispensing the liquid L contained therein.

Figure 3:
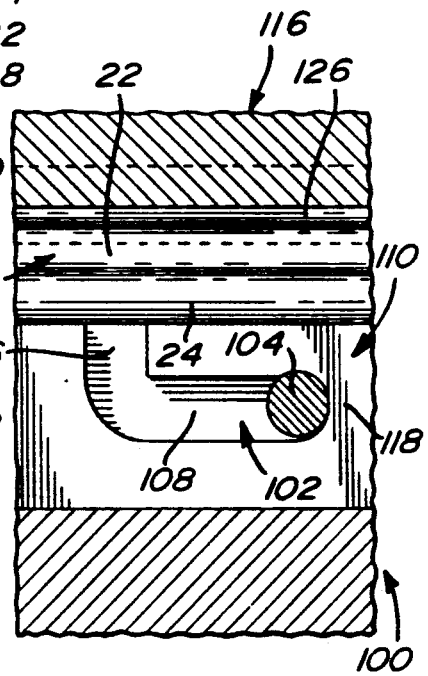
FIG. 3 is a cross-sectional view taken along lines 3—3 of FIG. 2 emphasizing the mounting of the closure to the container and the seal provided therebetween.
Figure 2:
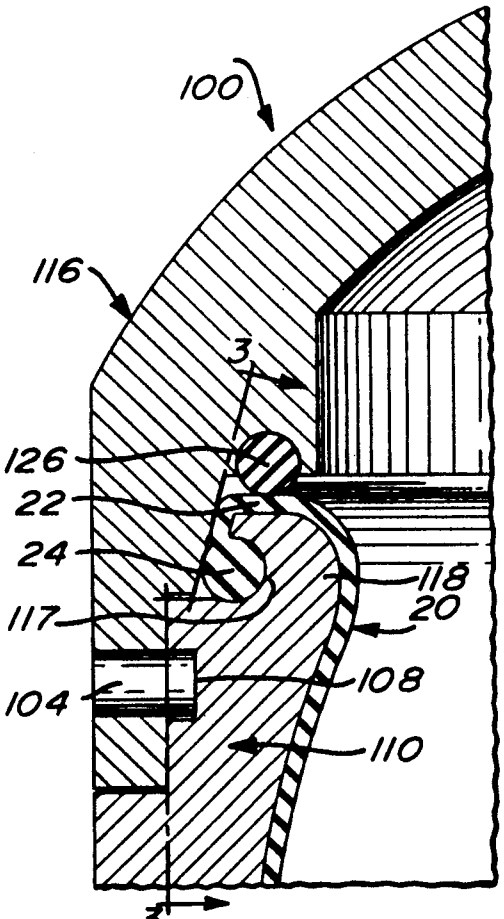
FIG. 2 is a cross-sectional elevation of part of a liquid spraying apparatus in accordance with the present invention illustrating an alternate seal therefor and a variant for mounting the bag and the cover to the container.

Now referring to FIGS. 2 and 3 which illustrate a different embodiment of the present invention, a closure 116 is secured to a sidewall 110 of an alternate container 100 using a quick fastening connection, such as a bayonet catch. For doing so, an L-shaped groove 102 is defined in the outer surface of an upper end 118 of the sidewall 110, the L-shaped groove 102 cooperating with a pin 104 extending inwards from the closure 116.

In both the threaded and bayonet connections, the closures cannot be removed from the container when the same is pressurized.

It is easily seen that to secure the closure 116 to the sidewall 110, the pin 104 of the closure 116 is downwardly engaged in a vertical part 106 of the L-shaped groove 102. Then, the closure 116 is rotated in a horizontal plane so that the pin 104 thereof displaces in a horizontal section 108 of the L-shaped groove 102 until abutting the end thereof.

FIGS. 2 and 3 also illustrate a variant for mounting the bag 20 between the closure 116 and the sidewall 110 of the container 100. In this case, the integral O-ring 24 of the bag 20 is positioned in an annular groove 117 defined on the outer surface of the upper end 118 of the sidewall 110 at a location higher than the L-shaped groove 102. At that point, the upper end 118 has a frusto-conical shape to facilitate the positioning of the O-ring 24 in the annular groove 117 defined therein. Furthermore, the frusto-conical upper end 118 in conjunction with the O-ring 24 allows the bag 20 to be firmly secured to the sidewall 110 even before the mounting of the closure 116 thereon. It is noted that in the embodiment of FIG. 1, the annular groove is defined on the top of the sidewall 10 of the container C, in which case the bag 20 is not as well secured thereto until the closure 16 is mounted to the sidewall 10.

The closure 116 is provided with a further O-ring 126 which bears against the upper end 22 of the bag 20 to provide a complete seal.

Figure 4:
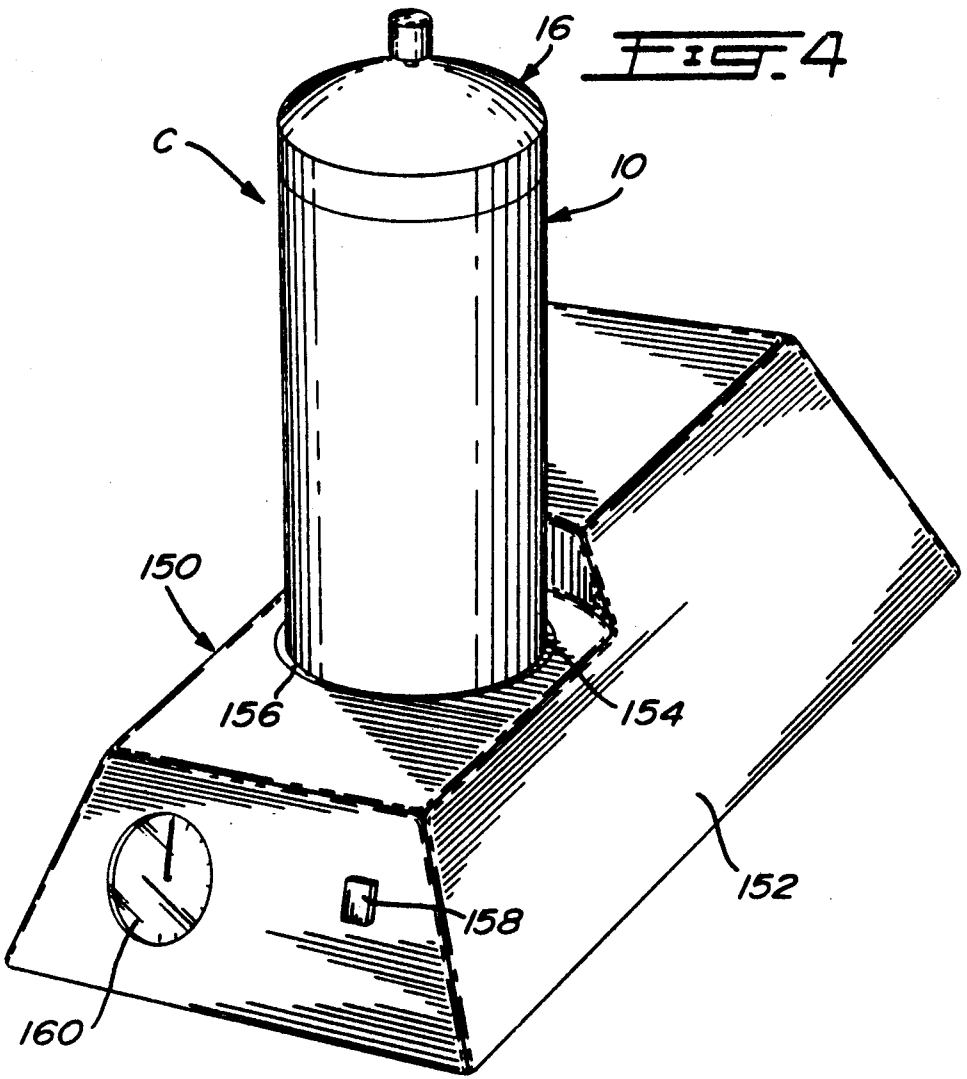
FIG. 4 is a perspective view of a tabletop compressor unit provided with a liquid spraying apparatus in accordance with the present invention.

FIG. 4 illustrates a tabletop electric compressor unit 150 which comprises a housing 152 with a compressor (not shown) enclosed therein. A circular recess 154 is defined to receive a lower end of the container C in order that the admission valve 52 thereof communicates with the compressor. A resilient member 156 is provided to secure the container C to the tabletop compressor unit 150.

A supply nozzle (not shown) is located in the recess 154 to engage the admission valve 52 of the container C to provide communication between the compressor and the container C. Therefore, when the container C is secured to the compressor unit 150, the remaining air is evacuated through the supply nozzle of the compressor unit 150 which opens the admission valve 52. The container C being depressurized, the closure 16 can be removed therefrom.

With the pressure regulating valve V being open, the air between the bag 20 and the sidewall 10 is evacuated from the upper sub-chamber 44. This facilitates the positioning of the bag 20 in the upper sub-chamber 44 prior to refilling the bag 20. Finally, a new supply of liquid poured in the bag 20 properly settles the same against the walls of the container C defining the upper sub-chamber 44. The refilling of the bag 20 is further facilitated by the stability of the container C as it is solidly secured to the compressor unit 150.

Once the bag 20 has been refilled, the closure 16 is secured to the sidewall 10. Then, to fill the container C with compressed air A, the compressor is actuated by way of push button 158. The container C is filled with the desired air pressure using an air pressure indicating dial 160 of the tabletop compressor unit 150. A predetermined pressure cannot be exceeded in the container C due to the safety valves 58 and 60 thereof. The tabletop compressor unit 150 includes of course all the necessary auxiliary devices to complement the compressor thereof.

Now generally referring to FIG. 1, features of the present invention not previously described are presented hereinafter. As explained hereinabove, the tube 34 of the nozzle 32 does not need to extend to the bottom of the bag 20. Furthermore, experiments have shown that the tube 54 is not necessary as the level of the liquid L reaches the nozzle 32 adjacent the inner surface of the closure 16. On the other hand, the tube 34 prevents the bag from blocking the inlet of the nozzle 32 as the bag 20 has a tendency to generally wrap around the tube 34 as the bag 20 is gradually emptied.

Various constructions of the nozzles 32 produce various streams or sprays depending on the liquid L being discharged and the intended application thereof. Different flows, shapes as well as various diffusion angles can be obtained depending on the construction of the chosen nozzle.

Different bags 20 can also be used depending on the liquid and its consistency and weight.

If the bag 20 is strong enough to support a full load of liquid L therein, the annular member 40 can be eliminated as the bag does not need any support. On the other hand, the annular member 40 may still be used to mount the pressure regulating valve V in the second chamber 30 although other constructions could be used to mount the pressure regulating valve V inside the container C.

It is noted that the bag 20 can be fixedly mounted to the sidewall 10 of the container C.

Moreover, the bag 20, instead of using the O-ring 24 compressed between the closure 16 and the sidewall 10, can be mounted inside the container C with a biased annular member which forces the upper end 22 of the bag 20 against an inner surface of the upper end 18 of the sidewall 10, the bag being secured between the sidewall 10 and the biased annular member.

It is further noted that the bags 20 are removable from the container C whereby they can be changed or remotely refilled. Moreover, the bags 20 may be sold with the liquid L already therein.

The above application is not solely restricted to the discharge of liquids. Indeed, a gas can be contained in the first chamber 28 if such a gas is intended to be expelled from the container C. Furthermore, thick liquids such as skin creams can also be dispensed by a container in accordance with the present invention. For doing so, the operating pressures must be established and the pressure regulating valve and safety valves adjusted accordingly. Moreover, the appropriate nozzle must be chosen.

It is noted that air is an ideal propellant as it is readily available, free, safe, non pulluting and easily compressible. On the other hand, air contains oxygen which could have resulted in certain liquids degrading by oxidation if a flexible separator such as the bag 20 had not been provided between the liquid L and the compressed air A.

Also, since the level of the liquid L in the first chamber 28 is substantially constant and thus in contact with the nozzle assembly (which does not extend to the bottom of the bag), the container C can be oriented in any direction with the liquid still being able to be discharged therefrom as being always in contact with the nozzle assembly.

Experiments have shown that the bag 20 which contracts along the tube 34 of the nozzle 32 is emptied completely of its content as all the liquid L has been atomized or vaporized.

Having the O-ring 24 integral to the upper end 22 of the bag 20 prevents air from infiltrating under the pleats of the bag 20. Such an integral O-ring 24 also facilitates the proper positioning of the bag 20 on the sidewall 10 of the container C. Preferably, the O-ring is made of a rubber material.

The principle characteristics which are needed for the bag 20 are flexibility, elastic mechanical resistance and resistance to deterioration. Furthermore, the bag 20 must not react either with the liquid L nor the compressed air A.

The internal walls of the sidewall 10, the bottom wall 12 and the closure 16 can be provided with a plastic coating to prevent corrosion.

Also, it is noted that the bottom wall 12 can be mounted to the sidewall 10 by a conventional pressing process.

Annular teflon members or strips can be provided on cooperating surfaces of the sidewall 10 and the closure 16 in order to facilitate the mounting and the removal of the closure 16 with respect to the sidewall 10.

It is further noted that the atomization and discharge of the liquid L from the container C is very quiet since the compressed air A is not ejected therewith.

The physics principles on which the present invention are based hereinfollow. A liquid being incompressible transmits integrally all forces to which it is submitted. Therefore, a pressure applied to a bag containing a liquid will be transmitted integrally to the dispensing nozzle having an inlet immerged in the liquid. This principle allows for a stream to emit from the nozzle when the valve of the nozzle is opened as the force transmitted by the liquid forces the same to be expelled. The pressure regulating valve ensures a constant pressure on the bag whereby the atomized spray is of constant flow and shape. It is easily understood that if the kinetic energy of the liquid's sufficient, a nozzle by its physical characteristics will atomize the liquid.

I claim:

1. A fluid dispensing apparatus comprising a container, a displaceable partition means in said container for defining therein first and second separate variable volume chamber means containing respectively a fluid and a propellant means, said second chamber means comprising first and second sub-chambers and a pressure regulating means provided therebetween; said pressure regulating means being adapted so that the propellant means in said first sub-chamber exerts a substantially constant pressure on said partition means and therefore on said fluid, an operable fluid dispensing means extending through said container, into said first chamber means, whereby actuation of said fluid dispensing means causes at least part of said fluid to discharge from said container, said pressure regulating means comprising bleeding means to allow pressurized propellant means to flow therethrough from said first sub-chamber to said second sub-chamber when said second sub-chamber is substantially unpressurized, whereby depressurization of said second sub-chamber also results in the depressurization of said first sub-chamber.

2. A fluid dispensing apparatus as defined in claim 1, wherein said container comprises an upstanding tubular sidewall, and a closure and a bottom wall mounted respectively at upper and lower ends of said sidewall, said fluid dispensing means extending through said closure, and wherein said displaceable partition mean sis a flexible tight bag mounted at an upper open end thereof to said container said bag containing said fluid with said propellant means in said first sub-chamber exerting pressure on said bag, a sealing means being provided for preventing said propellant means from entering said first chamber means.

3. A fluid dispensing apparatus as defined in claim 2, wherein said propellant means is a compressed gas, and wherein said bag is made of a plastics material.

4. A fluid dispensing apparatus as defined in claim 3, wherein said compressed gas is compressed air.

5. A fluid dispensing apparatus as defined in claim 3, wherein said plastic material is latex.

6. A fluid dispensing apparatus as defined in claim 2, wherein said sidewall comprises an annular member extending radially inwardly therefrom intermediate said upper and lower ends thereof thereby defining a throat in said second chamber means below said bag, said pressure regulating means comprising a pressure regulating valve mounted to said throat, whereby said first and second sub-chambers are respectively upper and lower sub-chambers, a bottom of said bag hanging in said upper sub-chamber being at least partly supported by said annular member at least when said bag is filled with said fluid, said lower sub-chamber acting as a reservoir for said upper sub-chamber for ensuring by way of said pressure regulating valve compressed air of substantially constant pressure in said upper sub-chamber, whereby said fluid is discharged with a substantially constant flow from said first chamber means.

7. A fluid dispensing apparatus as defined in claim 6, wherein said closure is removably mounted to said sidewall, an admission means extending through said container into said lower sub-chamber for the filling thereof with compressed air, at least a first safety valve means being provided in said lower sub-chamber, whereby said fluid dispensing apparatus is refillable with propellant means.

8. A fluid dispensing apparatus as defined in claim 7, wherein an O-ring urges said upper open end of said bag in a peripheral groove defined in an outer surface of said upper end of said sidewall for removably mounting said bag to said container, said O-ring being further urged in said groove by said closure thereby preventing said fluid and said compressed air from leaking from said container.

9. A fluid dispensing apparatus as defined in claim 8, wherein said O-ring means is integral to said upper open end of said bag, said groove being defined with a substantially semi-circular cross-section, said upper end of said sidewall having a frusto-conical shape for facilitating the positioning of said O-ring in said groove.

10. A fluid dispensing apparatus as defined in claim 7, wherein a first tube extends from said pressure regulating valve into said upper sub-chamber, and further extends between said bag and said sidewall, said first tube opening up near said upper end of said sidewall in order to prevent, upon rupture of said bag, said fluid escaping therefrom from blocking said pressure regulating valve, and wherein said admission means comprises a second tube extending therefrom, said second tube opening up at a lowermost part of said lower sub-chamber, whereby, upon depressurization of said container by way of said admission means, a condensate formed in said lower sub-chamber is simultaneously evacuated therefrom through said second tube and said admission means.

11. A fluid dispensing apparatus as defined in claim 7, wherein said closure is threadably engaged on said sidewall, and wherein an annular seal is mounted in said closure for providing a further seal between said closure and said upper end of said bag.

12. A fluid dispensing apparatus as defined in claim 7, wherein a second safety valve means is provided in said upper sub-chamber.

13. A fluid dispensing apparatus as defined in claim 7, wherein said admission means is a valve which extends through said bottom wall of said container.

14. A fluid dispensing apparatus as defined in claim 7, wherein said admission means extends through said bottom wall, said apparatus being in combination with a tabletop compressor unit comprising a housing enclosing a compressor, said housing including means adapted for holding said container thereon and for supplying compressed air to said container through said admission means upon actuation of said compressor, whereby said container can be refilled with compressed air.

15. A fluid dispensing apparatus as defined in claim 14, wherein said tabletop compressor unit further comprises a pressure regulating means for controlling the pressure of the compressed air supplied thereby to said container.

16. A fluid dispensing apparatus as defined in claim 7, wherein said closure is mounted with a bayonet catch to said sidewall, and wherein an annular seal is mounted in said closure for providing a further seal between said closure and said upper end of said bag.

17. A fluid dispensing apparatus as defined in claim 2, wherein said fluid dispensing means comprises a nozzle mounted to said closure, said nozzle including a discharge opening, a valve means and a tube which extends downwards from said nozzle in said first chamber means, whereby, upon actuation of said nozzle, said fluid is discharged from said fluid dispensing apparatus through said discharge opening of said nozzle.

18. A fluid dispensing apparatus comprising a container which includes an upstanding tubular sidewall and a bottom wall mounted at a lower end of said sidewall, said container also comprising a removable closure mounted to an upper end of said sidewall, a flexible tight bag having an upper peripheral open end and hanging in said container with said upper open end thereof being peripherally mounted between said closure and said upper end of said sidewall, said bag defining first and second chambers in said container containing respectively a fluid and compressed air, a fluid dispensing means extending through said closure into said first chamber, a partition wall means extending inwards from said sidewall in said container lower than said bag and a pressure regulating means mounted to said partition wall means defining in said second chamber an upper and a lower sub-chamber, said pressure regulating means being adapted to provide a substantially constant air pressure in said upper sub-chamber and thus on said bag, an admission means extending through said container into said lower sub-chamber for filling said container with compressed air, said pressure regulating means comprising bleeding means to allow compressed air to flow therethrough from said upper sub-chamber to said lower sub-chamber when said lower sub-chamber is substantially unpressurized, whereby depressurization of said lower sub-chamber also results in the depressurization of said upper sub-chamber.

19. A fluid dispensing apparatus as defined in claim 18, wherein said admission means extends through said bottom wall, said apparatus being in combination with a tabletop compressor unit comprising a housing enclosing a compressor, said housing including means adapted for holding said container thereon and for supplying compressed air to said container upon actuation of said compressor, whereby said container can be refilled with compressed air, said tabletop compressor unit further comprising a pressure regulating means for controlling the pressure of the compressed air supplied thereby to said container.

* * * * *

UNITED STATES PATENT AND TRADEMARK OFFICE

CERTIFICATE OF CORRECTION

PATENT NO. : 5,179,982

DATED : January 19, 1993

INVENTOR(S) : Martin Bérubé et al.

It is certified that error appears in the above-identified patent and that said Letters Patent is hereby corrected as shown below:

Title page, after item [22] insert --

Item [30] Foreign Application Priority: March 2, 1990 [CA] -- Canada 2011406

Signed and Sealed this

Nineteenth Day of March, 1996

Bruce Lehman

BRUCE LEHMAN

*Commissioner of Patents and Trademarks*

*Attest:*

*Attesting Officer*